US009626905B2

(12) United States Patent
In et al.

(10) Patent No.: US 9,626,905 B2
(45) Date of Patent: Apr. 18, 2017

(54) PIXEL CIRCUIT AND ELECTROLUMINESCENT DISPLAY INCLUDING THE SAME

(71) Applicant: Samsung Display Co., Ltd., Yongin, Gyeonggi-Do (KR)

(72) Inventors: Hai-Jung In, Seoul (KR); Yong-Sung Park, Seoul (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/535,059

(22) Filed: Nov. 6, 2014

(65) Prior Publication Data

US 2015/0348464 A1 Dec. 3, 2015

(30) Foreign Application Priority Data

May 29, 2014 (KR) ..... 10-2014-0065307

(51) Int. Cl.
*G09G 3/32* (2016.01)
*G09G 3/3233* (2016.01)
*G09G 3/20* (2006.01)

(52) U.S. Cl.
CPC ..... *G09G 3/3233* (2013.01); *G09G 3/2022* (2013.01); *G09G 2300/0819* (2013.01);
(Continued)

(58) Field of Classification Search
CPC ..... G09G 3/3233
See application file for complete search history.

(56) References Cited

U.S. PATENT DOCUMENTS

2007/0273619 A1* 11/2007 Kitazawa ..... G09G 3/3233 345/76
2008/0036710 A1* 2/2008 Kim ..... G09G 3/3233 345/82

(Continued)

FOREIGN PATENT DOCUMENTS

KR 10-2008-0001482 A 1/2008
KR 10-0821046 B1 4/2008

(Continued)

*Primary Examiner* — Seokyun Moon
*Assistant Examiner* — Peijie Shen
(74) *Attorney, Agent, or Firm* — Knobbe Martens Olson & Bear LLP

(57) ABSTRACT

A pixel circuit and an electroluminescent display including the same are disclosed. In one aspect, the pixel circuit includes a scan transistor connected between a data line and a first node and having a gate electrode configured to receive a scan signal, a driving transistor connected between a first power supply voltage and a third node and having a gate electrode connected to a second node, an emission control transistor connected between the third node and a fourth node and having a gate electrode configured to receive an emission control signal, a light-emitting diode connected between the fourth node and a second power supply voltage less than the first power supply voltage, and a compensation circuit initializes the second node to an initial voltage during a first compensation period and electrically connects the second node to the third node during a second compensation period following the first compensation period.

17 Claims, 12 Drawing Sheets

(52) U.S. Cl.
CPC ..... *G09G 2300/0852* (2013.01); *G09G 2300/0861* (2013.01); *G09G 2310/063* (2013.01); *G09G 2320/0233* (2013.01); *G09G 2320/045* (2013.01)

(56) References Cited

U.S. PATENT DOCUMENTS

| | | | | |
|---|---|---|---|---|
| 2008/0143651 | A1 | 6/2008 | Choi et al. | |
| 2011/0227885 | A1* | 9/2011 | Chung ..... | G09G 3/3241 345/204 |
| 2014/0176006 | A1 | 6/2014 | Kawabe | |

FOREIGN PATENT DOCUMENTS

| | | | |
|---|---|---|---|
| KR | 10-2010-0126529 | A | 12/2010 |
| KR | 10-1048951 | B1 | 7/2011 |

* cited by examiner

PIXEL CIRCUIT AND ELECTROLUMINESCENT DISPLAY INCLUDING THE SAME

CROSS REFERENCE TO RELATED APPLICATION

This application claims priority under 35 U.S.C. §119 to Korean Patent Application No. 10-2014-0065307 filed on May 29, 2014, the disclosure of which is hereby incorporated by reference herein in its entirety.

BACKGROUND

Field

The described technology generally relates to a pixel circuit and an electroluminescent display including the pixel circuit.

Description of the Related Art

Recently, various display devices such as liquid crystal displays (LCD), plasma displays, and electroluminescent displays have gained popularity. Particularly, the electroluminescent display can be driven with quick response speed and reduced power consumption, using a light-emitting diode (LED) or an organic light-emitting diode (OLED) that emits light through recombination of electrons and holes.

The electroluminescent display can be driven with an analog or a digital driving method. While the analog driving method produces grayscale using variable voltage levels corresponding to input data, the digital driving method produces grayscale using variable time duration in which the LED emits light. The analog driving method is difficult to implement because it requires a driving integrated circuit (IC) that is complicated to manufacture if the display is large and has high resolution. The digital driving method, on the other hand, can readily accomplish the required high resolution through a simpler IC structure.

SUMMARY OF CERTAIN INVENTIVE ASPECTS

One inventive aspect is a pixel circuit that is robust to variation factors such as change of temperature and/or voltage, deviation in threshold voltage of a driving transistor, degradation of a light emitting diode, etc.

Another aspect is an electroluminescent display device including the pixel circuit robust to the variation factors.

Another aspect is a pixel circuit of an electroluminescent display device that includes, a scan transistor, a first capacitor, a second capacitor, a driving transistor, an emission control transistor, a light emitting diode and a compensation circuit. The scan transistor is coupled between a data line and a first node, and a gate electrode of the scan transistor receives a scan signal. The first capacitor is coupled between a first power supply voltage and the first node. The second capacitor is coupled between the first node and a second node. The driving transistor is coupled between the first power supply voltage and a third node, and a gate electrode of the driving transistor is coupled to the second node. The emission control transistor is coupled between the third node and a fourth node, and a gate electrode of the emission control transistor receives an emission control signal. The light emitting diode is coupled between the fourth node and a second power supply voltage that is lower than the first power supply voltage. The compensation circuit initializes the second node to an initial voltage during a first compensation period and electrically connects the second node and the third node during a second compensation period after the first compensation period.

The compensation circuit can apply a reference voltage to the first node during the first compensation period and the second compensation period.

The driving transistor can be turned on when a data voltage is lower than the reference voltage and the driving transistor is turned off when the data voltage is higher than the reference voltage.

The compensation circuit can apply the initial voltage to the fourth node during the first compensation period or the second compensation period.

Each frame period can include the first compensation period, the second compensation period after the first compensation period, and a scan period after the second compensation period, and the scan transistor can be turned on during the scan period.

The initial voltage can be lower than the first power supply voltage subtracted by a threshold voltage of the driving transistor.

The initial voltage can be equal to the second power supply voltage.

The compensation circuit can include a first transistor and a second transistor. The first transistor can be coupled between the second node and the initial voltage, and a gate electrode of the first transistor can receive a first compensation control signal that is activated during the first compensation period. The second transistor can be coupled between the second node and the third node, and a gate electrode of the second transistor can receive a second compensation control signal that is activated during the second compensation period.

The compensation circuit can further include a third transistor and a fourth transistor. The third transistor can be coupled between the first node and a reference voltage, and a gate electrode of the third transistor can receive the first compensation control signal. The fourth transistor can be coupled between the first node and the reference voltage, and a gate electrode of the fourth transistor can receive the second compensation control signal.

The compensation circuit can further include a fifth transistor coupled between the fourth node and the initial voltage, and a gate electrode of the fifth transistor can receive the first compensation control signal or the second compensation control signal.

The driving transistor can operate in a saturation region.

Another aspect is an electroluminescent display device that includes a display unit, a data driver, a scan driver and a timing controller. The display unit includes a plurality of pixel circuits that are arranged in rows and columns. Each pixel circuit is configured to initialize a gate electrode of a driving transistor to an initial voltage during a first compensation period and electrically connect the gate electrode and a drain electrode of the driving transistor during a second compensation period after the first compensation period. The data driver provides data signals to the display unit and the scan driver provides row control signals to the display unit. The timing controller controls the display unit, the data driver and the scan driver.

The scan driver can generate a plurality of compensation control signals that are activated sequentially.

A (k−1)-th compensation control signal and a k-th compensation control signal among the plurality of compensation control signals can be provide to the pixel circuits of a k-th row.

Each pixel circuit of the k-th row can initialize the gate electrode of the driving transistor to the initial voltage while the (k−1)-th compensation control signal is activated and electrically connect the gate electrode and the drain electrode of the driving transistor while the k-th compensation control signal is activated.

The scan driver can generate a first compensation control signal and a second compensation control signal that are activated sequentially.

The first compensation control signal and the second compensation control signal can be provided commonly to the pixel circuits of all rows.

Each pixel circuit of all rows can initialize the gate electrode of the driving transistor to the initial voltage while the first compensation control signal is activated and electrically connect the gate electrode and the drain electrode of the driving transistor while the second compensation control signal is activated.

Each pixel circuit include a scan transistor, a first capacitor, a second capacitor, a driving transistor, an emission control transistor, a light emitting diode and a compensation circuit. The scan transistor is coupled between a data line and a first node, and a gate electrode of the scan transistor receives a scan signal. The first capacitor is coupled between a first power supply voltage and the first node. The second capacitor is coupled between the first node and a second node. The driving transistor is coupled between the first power supply voltage and a third node, and the gate electrode of the driving voltage is coupled to the second node. The emission control transistor is coupled between the third node and a fourth node, and a gate electrode of the emission control transistor receiving an emission control signal. The light emitting diode is coupled between the fourth node and a second power supply voltage that is lower than the first power supply voltage. The compensation circuit is configured to initialize the second node to an initial voltage during the first compensation period and electrically connect the second node and the third node during the second compensation period after the first compensation period.

The compensation can circuit include first through fourth transistors. The first transistor can be coupled between the second node and the initial voltage, and a gate electrode of the first transistor can receive a first compensation control signal that is activated during the first compensation period. The second transistor can be coupled between the second node and the third node, and a gate electrode of the second transistor can receive a second compensation control signal that is activated during the second compensation period. The third transistor can be coupled between the first node and a reference voltage, and a gate electrode of the third transistor can receive the first compensation control signal. The fourth transistor can be coupled between the first node and the reference voltage, and a gate electrode of the fourth transistor can receive the second compensation control signal.

Another aspect is a pixel circuit for an electroluminescent display comprising a scan transistor connected between a data line and a first node and having a gate electrode configured to receive a scan signal, a first capacitor connected between a first power supply voltage and the first node, a second capacitor connected between the first node and a second node, a driving transistor connected between the first power supply voltage and a third node and having a gate electrode connected to the second node, an emission control transistor connected between the third node and a fourth node and having a gate electrode configured to receive an emission control signal, a light-emitting diode (LED) connected between the fourth node and a second power supply voltage less than the first power supply voltage, and a compensation circuit configured to i) initialize the second node to an initial voltage during a first compensation period and ii) electrically connect the second node to the third node during a second compensation period following the first compensation period.

In the above pixel circuit, the compensation circuit is further configured to apply a reference voltage to the first node during the first and second compensation periods. In the above pixel circuit, the driving transistor is configured to be turned on when a data voltage on the data line is less than the reference voltage, wherein the driving transistor is configured to be turned off when the data voltage is greater than the reference voltage.

In the above pixel circuit, the compensation circuit is further configured to apply the initial voltage to the fourth node during the first or second compensation period.

In the above pixel circuit, the first and second compensation periods and a scan period after the second compensation period are defined as a frame period of the electroluminescent display, wherein the scan transistor is configured to be turned on during the scan period.

In the above pixel circuit, the initial voltage is less than the difference between the first power supply voltage and a threshold voltage of the driving transistor.

In the above pixel circuit, the initial voltage is substantially equal to the second power supply voltage.

In the above pixel circuit, the compensation circuit includes a first transistor connected between the second node and an initial voltage node having the initial voltage, wherein the first transistor comprises a gate electrode configured to receive a first compensation control signal that is activated during the first compensation period. In the above pixel circuit, the compensation circuit further includes a second transistor connected between the second node and the third node and having a gate electrode configured to receive a second compensation control signal that is activated during the second compensation period.

In the above pixel circuit, the compensation circuit further includes a third transistor connected between the first node and a reference voltage node having a reference voltage, wherein the third transistor comprises a gate electrode configured to receive the first compensation control signal. In the above pixel circuit, the compensation circuit further includes a fourth transistor connected between the first node and the reference voltage node and having a gate electrode configured to receive the second compensation control signal.

In the above pixel circuit, the compensation circuit further includes a fifth transistor connected between the fourth node and the initial voltage node and having a gate electrode configured to receive the first compensation control signal or the second compensation control signal.

In the above pixel circuit, the driving transistor is configured to operate in a saturation region.

Another aspect is an electroluminescent display comprising a display unit including a plurality of pixel circuits arranged in rows and columns, wherein each pixel circuit includes a driving transistor including a gate electrode configured to be initialized to an initial voltage during a first compensation period and is configured to turn on the driving transistor during a second compensation period following the first compensation period. The electroluminescent display further comprises a data driver configured to provide data signals to the display unit, a scan driver configured to provide row control signals to the display unit, and a timing controller configured to control the display unit, the data driver and the scan driver.

In the above electroluminescent display, the scan driver is configured to generate and sequentially activate a plurality of compensation control signals. In the above electroluminescent display, the pixel circuits of a k-th row are configured to receive (k−1)-th and k-th compensation control signals. In the above electroluminescent display, each pixel circuit of the k-th row is configured to initialize the gate electrode to the initial voltage while the (k−1)-th compensation control signal is activated and turn on the driving transistor while the k-th compensation control signal is activated.

In the above electroluminescent display, the scan driver is configured to generate and sequentially activate first and second compensation control signals. In the above electroluminescent display, each of the pixel circuits is further configured to receive the first and second compensation control signals. In the above electroluminescent display, each pixel circuit is configured to initialize the gate electrode to the initial voltage while the first compensation control signal is activated and turn on the driving transistor while the second compensation control signal is activated.

In the above electroluminescent display, each pixel circuit includes a scan transistor connected between a data line and a first node and having a gate electrode configured to receive a scan signal, a first capacitor connected between a first power supply voltage and the first node, a second capacitor connected between the first node and a second node, an emission control transistor connected between a third node and a fourth node and having a gate electrode configured to receive an emission control signal, a light-emitting diode (LED) connected between the fourth node and a second power supply voltage less than the first power supply voltage, and a compensation circuit configured to initialize the second node to an initial voltage during the first compensation period and electrically connect the second node to the third node during the second compensation period, wherein the driving transistor is connected between the first power supply voltage and the third node, and wherein the gate electrode of the driving voltage is connected to the second node.

In the above electroluminescent display, the compensation circuit includes a first transistor having a gate electrode and connected between the second node and an initial voltage node having the initial voltage, wherein the gate electrode of the first transistor is configured to receive a first compensation control signal that is activated during the first compensation period. In the above electroluminescent display, the compensation circuit further includes a second transistor connected between the second node and the third node and having a gate electrode configured to receive a second compensation control signal that is activated during the second compensation period, a third transistor having a gate electrode and connected between the first node and a reference voltage node having a reference voltage, wherein the gate electrode of the third transistor is configured to receive the first compensation control signal. In the above electroluminescent display, the compensation circuit further includes a fourth transistor connected between the first node and the reference voltage node and having a gate electrode configured to receive the second compensation control signal.

DETAILED DESCRIPTION

In a digital driving method for an electroluminescent display, a problem can occur where the quality of a displayed image degrades due to deviations of the threshold voltage of transistors included in pixels, a resistive drop (IR-drop) of power supply voltages, etc. Compensation circuits can correct this deficiency.

In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
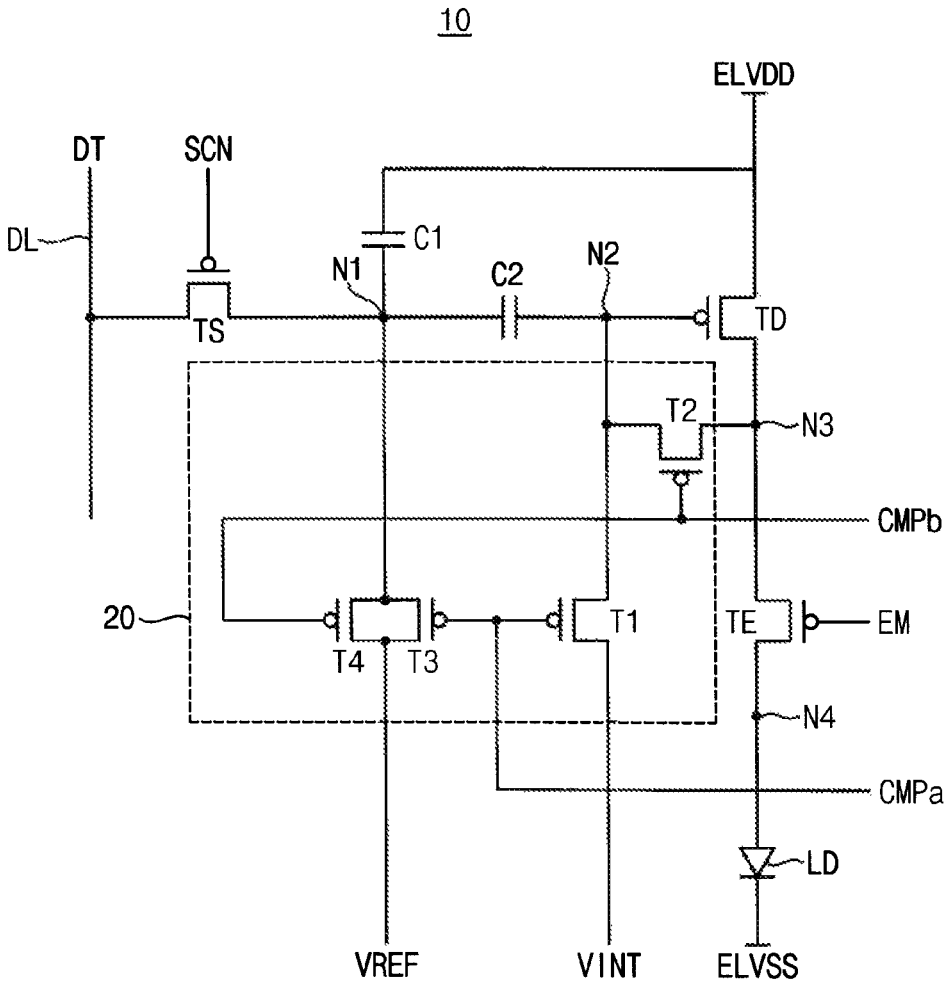
FIG. 1 is a circuit diagram illustrating a pixel circuit according to an example embodiment.

FIG. 1 is a circuit diagram illustrating a pixel circuit according to an example embodiment.

Referring to FIG. 1, a pixel circuit 10 includes a scan transistor TS, a first capacitor C1, a second capacitor C2, a driving transistor TD, an emission control transistor TE, a light-emitting diode (LED) LD and a compensation circuit 20.

The scan transistor TS is coupled between a data line DL and a first node N1, and a gate electrode of the scan transistor TS receives a scan signal SCN. The first capacitor C1 is coupled between a first power supply voltage ELVDD and the first node N1. The second capacitor C2 is coupled between the first node N1 and a second node N2. The driving transistor TD is coupled between the first power supply voltage ELVDD and a third node N3. A gate electrode of the driving transistor TD is coupled to the second node N2. The emission control transistor TE is coupled between the third node N3 and a fourth node N4. A gate electrode of the emission control transistor TE receives an emission control signal EM. The light-emitting diode LD is coupled between the fourth node N4 and a second power supply voltage ELVSS that is less than the first power supply voltage ELVDD.

FIG. 1 illustrates an embodiment of using p-channel metal-oxide semiconductor (PMOS) transistors. For example, the signals applied to the gate electrodes of the PMOS transistors are activated with a logical low level. Some transistors can be replaced with n-channel metal-oxide semiconductor (NMOS) transistors and the signals applied to the gate electrodes of the NMOS transistors can be activated with a logical high level.

When the scan signal SCN is activated with a logical low level, the scan transistor TS is turned on and a data voltage DT on the data line DL is applied to the first node N1. The voltage on the second node N2 depends on the data voltage DT when the driving transistor TD is turned on.

When the emission control signal EM is activated with the logical low level, the emission control transistor TE is turned on and a driving current is provided to the light-emitting diode LD depending on the data voltage DT. The on-off ratio of the light-emitting diode LD and brightness are determined by the driving current. The light-emitting diode LD can be any type, for example, an organic light-emitting diode (OLED).

The compensation circuit 20 initializes the second node N2 to an initial voltage or initial voltage node VINT during a first compensation period PC1 and electrically connects the second node N2 to the third node N3 during a second compensation period PC2 after the first compensation period PC1.

As illustrated in FIG. 1, the compensation circuit 20 includes a first transistor T1, a second transistor T2, a third transistor T3 and a fourth transistor T4, but the compensation circuit 20 is not limited thereto.

The first transistor T1 is coupled between the second node N2 and the initial voltage VINT, and a gate electrode of the first transistor T1 receives a first compensation control signal CMPa that is activated during the first compensation period PC1. The second transistor T2 is coupled between the second node N2 and the third node N3, and a gate electrode of the second transistor T2 receives a second compensation control signal CMPb that is activated during the second compensation period PC2. Using the first and second transistors T1 and T2, the second node N2 can be initialized to an initial voltage VINT during the first compensation period PC1. Further, the second node N2 and the third node N3 can be electrically connected to each other during the second compensation period PC2 after the first compensation period PC1.

The third transistor T3 is coupled between the first node N1 and a reference voltage or reference voltage node VREF, and a gate electrode of the third transistor T3 receives the first compensation control signal CMPa. The fourth transistor T4 is coupled between the first node N1 and the reference voltage VREF, and a gate electrode of the fourth transistor T4 receives the second compensation control signal CMPb. Using the third and fourth transistors T3 and T4, the reference voltage VREF can be applied to the first node N1 during the first compensation period PC1 and the second compensation period PC2.

Figure 2:
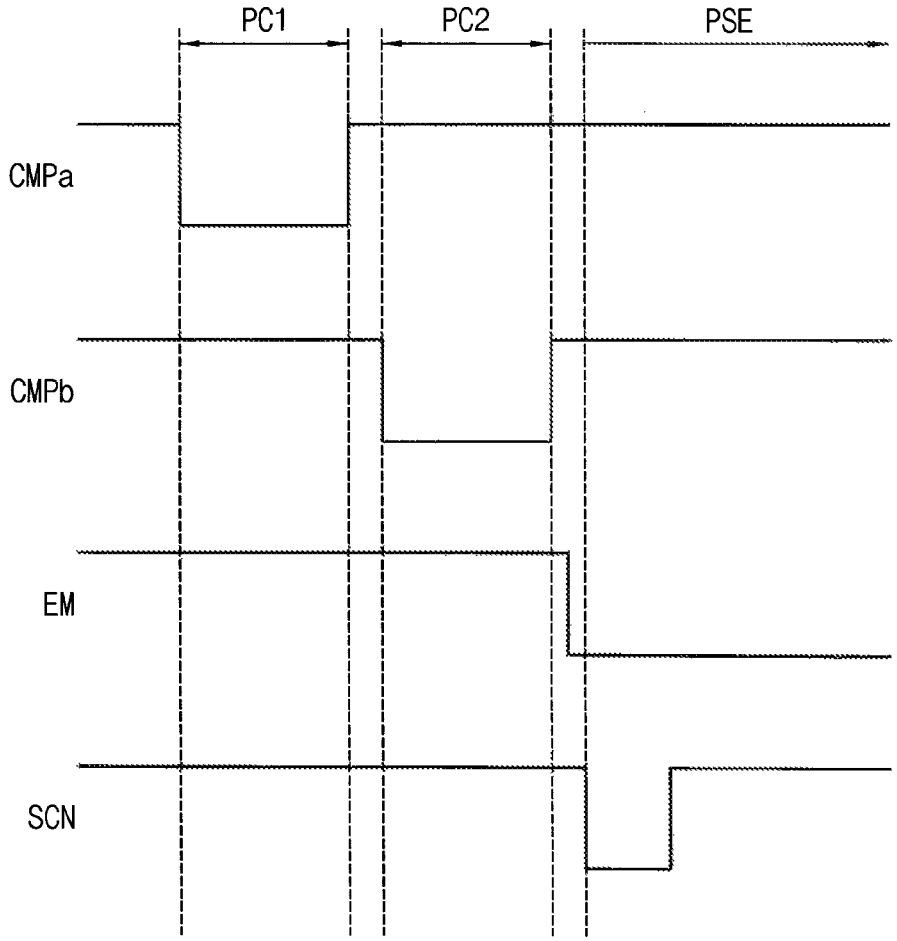
FIG. 2 is a timing diagram illustrating operations of the pixel circuit of FIG. 1.

FIG. 2 is a timing diagram illustrating operations of the pixel circuit 10 of FIG. 1.

Referring to FIG. 2, each frame period PF can include the first compensation period PC1, the second compensation period PC2 after the first compensation period PC1, and a scan-emission period PSE after the second compensation period PC2.

The first and second compensation control signals CMPa and CMPb are respectively activated with the logical low level during the first and second compensation periods PC1 and PC2. The scan-emission period PSE can include a scan period and at least one emission period PE. During the scan period, the scan signal SCN is activated with the logical low level and the scan transistor TS is turned on. During the emission period PE, the emission control signal EM is activated at the logical low level and the emission control transistor TE is turned on.

The relative timings between the emission period and the scan period in each frame period PF can be determined according to different driving methods. For example, for a progressive emission scheme where the emission control transistors TE are turned on sequentially row by row, the scan period PS can be included in the emission period PE as illustrated in FIG. 2. For example, the scan signal SCN can be activated to turn on the scan transistor TS while the emission control signal EM is activated to turn on the emission control transistor TE. The emission period PE can begin after the scan period PE in the progressive emission scheme. For a simultaneous emission scheme where the emission control transistors TE of all rows are turned on substantially simultaneously, the emission period PE has to begin after the scan period TS is finished with all of the rows.

Hereinafter, the operation of the pixel circuit 10 is further described with reference to FIGS. 1 and 2. The operation of the pixel circuit 10 are divided into the first compensation period PC1, the second compensation period PC2 and the scan-emission period PSE.

During the first compensation period PC1, the first compensation control signal CMPa is activated with the logical low level, and then the first and third transistors T1 and T3 are turned on. The second compensation control signal CMPb, the scan signal SCN and the emission control signal EM are deactivated with the logical high level, and then the scan transistor TS, the driving transistor TD, the emission control transistor TE, the second transistor T2 and the fourth transistor T4 are turned off. As a result, the reference voltage VREF is applied to the first node N1 and the initial voltage VINT is applied to the second node N2 during the first compensation period PC1. The initial voltage VINT can be set to be less than the first power supply voltage ELVDD subtracted by a threshold voltage VTH of the driving transistor TD, so that the driving transistor TD can be turned off. The initial voltage VINT can be set as a sufficiently low voltage, considering deviation of the threshold voltage of the driving transistor TD and boosting effect by the second capacitor C2. For example, the initial voltage VINT is set to the second power supply voltage ELVSS.

During the second compensation period PC2, the second compensation control signal CMPb is activated with the logical low level, and then the second and fourth transistors T2 and T4 are turned on. The first compensation control signal CMPa, the scan signal SCN and the emission control signal EM are deactivated with the logical high level, and then the scan transistor TS, the driving transistor TD, the emission control transistor TE, the first transistor T1 and the third transistor T3 are turned off. As a result, the reference voltage VREF is applied to the first node N1, and a diode-connection of the driving transistor TD is formed by electrically connecting the second node N2 to the third node N3 during the second compensation period PC2. Through the diode-connection, the first power supply voltage ELVDD subtracted by the threshold voltage VTH of the driving transistor TD is applied to the second node N2.

During the scan-emission period PSE, the first and second compensation control signals CMPa and CMPb are deactivated with the logical high level, and then the first through fourth transistors T1 through T4 are turned off. The emission control signal EM is activated with the logical low level, and then the emission control transistor TE is turned on.

As will be described with reference to FIG. 5, the frame period PF can include a plurality of scan-emission periods, for example, a plurality of sub-field driving periods. Each scan-emission period PSE can include a scan period PS for loading or programming a data bit to the first node N1. During the scan period PS, the scan signal SCN is activated with the logical low level to turn on the scan transistor TS and then the data voltage DT is applied to the first node N1. When the data voltage DT is applied to the first node N1, a voltage VB on the second node N2 is represented by Expression 1 by coupling of the second capacitor C2.

$$VB=(ELVDD-VTH+VDT-VREF) \quad \text{Expression 1}$$

In Expression 1, VB indicates the voltage at the second node N2, ELVDD indicates the first power supply voltage, VTH indicates the threshold voltage of the driving transistor TD, VDT indicates the data voltage programmed on the first node N1, and VREF indicates the reference voltage. The driving transistor TD operates in a saturation region as will be described with reference to FIG. 10, and thus a current ITD through the driving transistor TD can be represented as Expression 2.

$$\begin{aligned} ITD &= (1/2)*\mu*Cox*(W/L)*(ELVDD-VB-VTH)^2 \quad \text{Expression 2} \\ &= (1/2)*\mu*Cox*(W/L)*(VREF-VDT)^2 \end{aligned}$$

In Expression 2, ITD indicates the current flowing through the driving transistor TD, μ indicates the mobility of charge carriers of the driving transistor TD, Cox indicates a gate capacitance of the driving transistor TD, and W/L indicates the width/length of the driving transistor TD.

The driving transistor TD is turned on when the data voltage VDT is less than the reference voltage VREF and the driving transistor TD is turned off when the data voltage VDT is greater than the reference voltage VREF. If the data voltage VDT is less than the reference voltage VREF, the current ITD through the driving transistor TD is represented as Expression 2 and thus the current ITD has a value independent of the threshold voltage VTH and the first power supply voltage ELVDD. If the data voltage VDT is greater than the reference voltage VREF, the current ITD has a value of substantially zero because the driving transistor TD is turned off.

The data voltage VDT can be set to the logical high level greater than the reference voltage VREF and the logical low level less than the reference voltage VREF to control the switching operation, that is, the on-off ratio of the driving transistor TD. When the driving transistor TD is turned on, the current ITD as Expresssion2 flows through the light-emitting diode LD. When the driving transistor TD is turned off, substantially no current flows through the light-emitting diode LD. Using such switching operation, the emission time of the light-emitting diode LD can be controlled through a pulse width modulation scheme to represent grayscales.

As such, the pixel circuit 10 can compensate for the gate voltage of the driving transistor TD by reflecting the operational characteristics of the pixel circuit 10. The pixel circuit 10 can reduce variations of brightness of the displayed image due to deviations of the power supply voltage and the threshold voltage of the driving transistor TD. In addition, the pixel circuit 10 can reduce the variation of brightness due to temperature changes and degradation of the light-emitting diode LD since the driving transistor TD operates in the saturation region.

Figure 3:
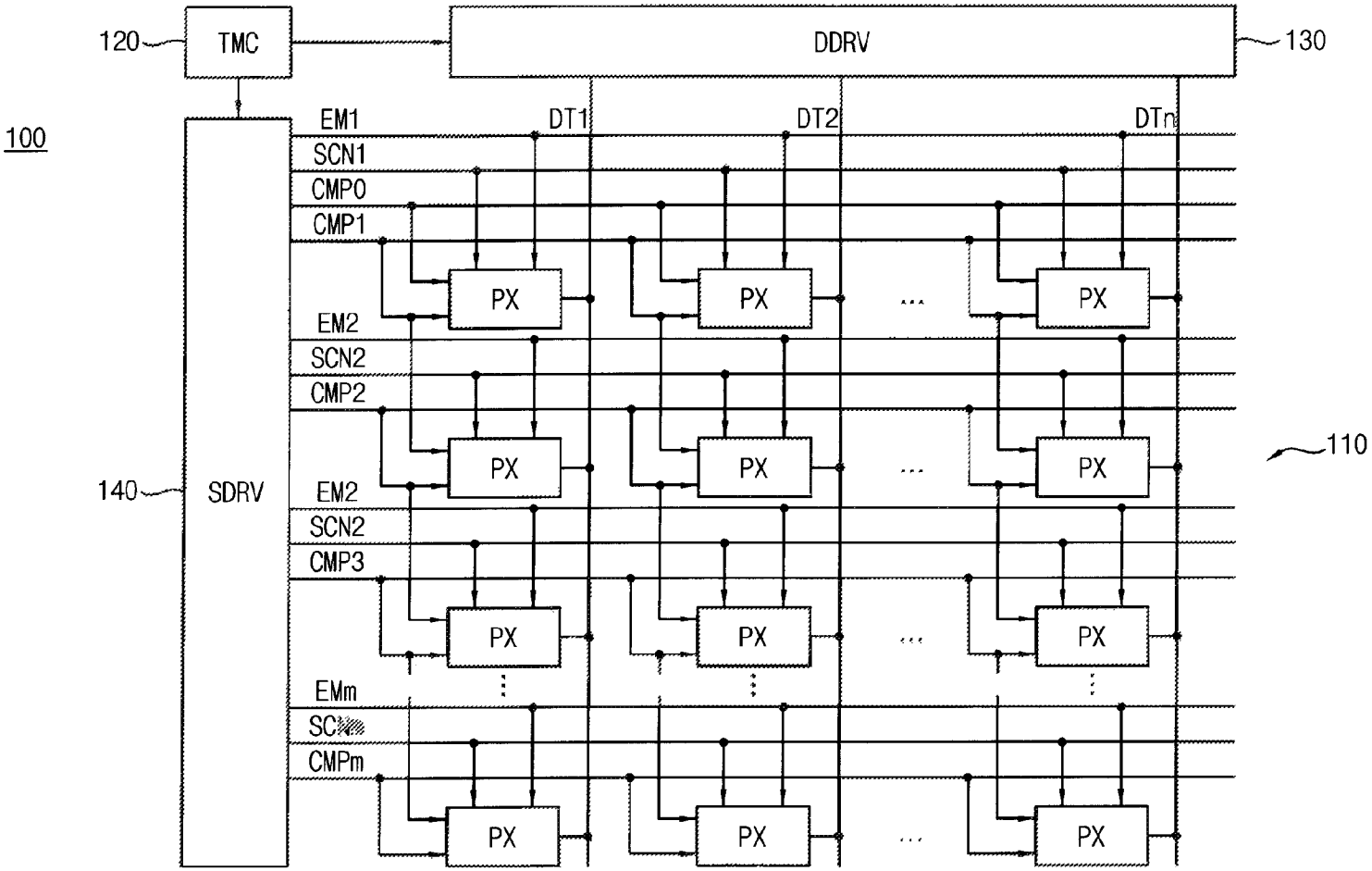
FIG. 3 is a block diagram illustrating an electroluminescent display according to an example embodiment.

FIG. 3 is a block diagram illustrating an electroluminescent display according to an example embodiment.

Referring to FIG. 3, an electroluminescent display 100 includes a display unit 110 and a driving unit. The driving unit includes a timing controller (TMC) 120, a data driver (DDRV) 130 and a scan driver (SDRV) 140. Even though not illustrated in FIG. 3, the electroluminescent display 100 can further include a buffer for storing image data to be displayed, a voltage generator, etc.

The display unit 110 includes a plurality of pixel circuits PX that are arranged in rows and columns. For example, the pixel circuits PX are arranged in a matrix form of m rows and n columns. The display unit 110 is coupled to the data driver 130 through a plurality of data lines, and is coupled to the scan driver 140 through a plurality of row control lines.

As described with reference to FIGS. 1 and 2, each pixel circuit PX can initialize the gate electrode of a driving transistor TD to the initial voltage VINT during the first compensation period PC1. Furthermore, each pixel circuit PX electrically connects the gate electrode to the drain electrode of the driving transistor TD during the second compensation period PC2 after the first compensation period PC1. Further, each pixel circuit PX can apply a reference voltage VREF to a first node N1 where the data bit is programmed during a scan period PS.

The data driver 130 provides data signals DT1~DTn to the display unit 110 through the data lines. The scan driver 140 provides row control signals to the display unit 110 through the row control lines. The row control signals include emission control signals EMP~EMm provided through emission control lines, scan signals SCN1~SCNm provided through scan lines, and compensation control signals CMP0~CMPm provided through compensation control lines. The pixel circuits PX can be located where the data lines and the scan lines cross.

The driving unit 120, 130 and 140 can receive display data from an external device and drive the display unit 110 so as to display an image corresponding to the display data. For example, the driving unit 120, 130 and 140 can drive the display unit 110 with a hybrid digital driving method. That is, the driving unit 120, 130 and 140 can provide each pixel circuit PX in the display unit 110 with a data voltage (e.g., a voltage for turning on a driving transistor TD or a voltage for turning off the driving transistor TD) that allows the driving transistor TD to operate in a saturation region. The driving unit 120, 130 and 140 can produce a grayscale by adjusting the time duration for which the pixel circuit PX emits light in each frame. Unlike a typical digital driving method in which a driving transistor of each pixel circuit operates in a linear region, in the hybrid digital driving method, the driving transistor TD of each pixel circuit PX operates in the saturation region, thereby increasing the lifespan of the pixel circuits PX.

The timing controller 120 can control overall operations of the electroluminescent display 100. The timing controller 120 can provide control signals to control the display unit 110, the data driver 130 and the scan driver 140. In some embodiments, the timing controller 120, the data driver 130 and the scan driver 140 can be implemented as a single integrated circuit (IC). In other embodiments, the timing controller 120, the data driver 130 and the scan driver 140 can be implemented as two or more ICs.

As illustrated in FIG. 3, the respective emission control signal EMk and the corresponding scan signal SCNk are provided to the pixel circuits PX of the corresponding k-th row. Among the plurality of compensation control signals CMP0~CPMm, the (k−1)-th compensation control signal CMPk−1 and the k-th compensation control signal CMPk are provided to the pixel circuits PX of the k-th row.

Hereinafter, the operation and the driving method of the electroluminescent display 100 are further described with reference to FIGS. 4 and 5.

Figure 4:
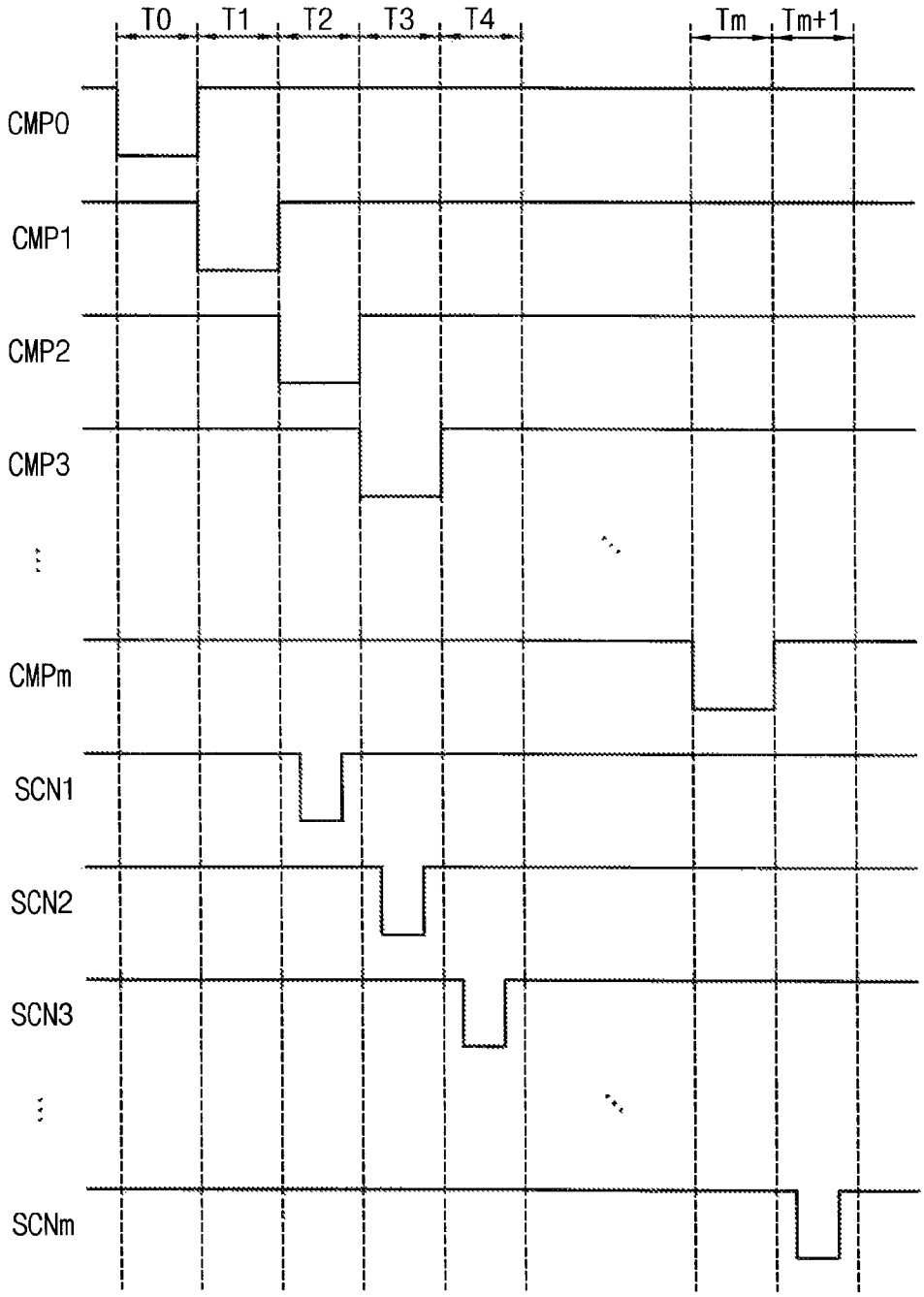
FIG. 4 is a timing diagram illustrating operations of the electroluminescent display of FIG. 3.

FIG. 4 is a timing diagram illustrating the operation of the electroluminescent display 100 of FIG. 3. FIG. 5 is a diagram illustrating an example of driving the electroluminescent display 100 of FIG. 3.

Figure 5:
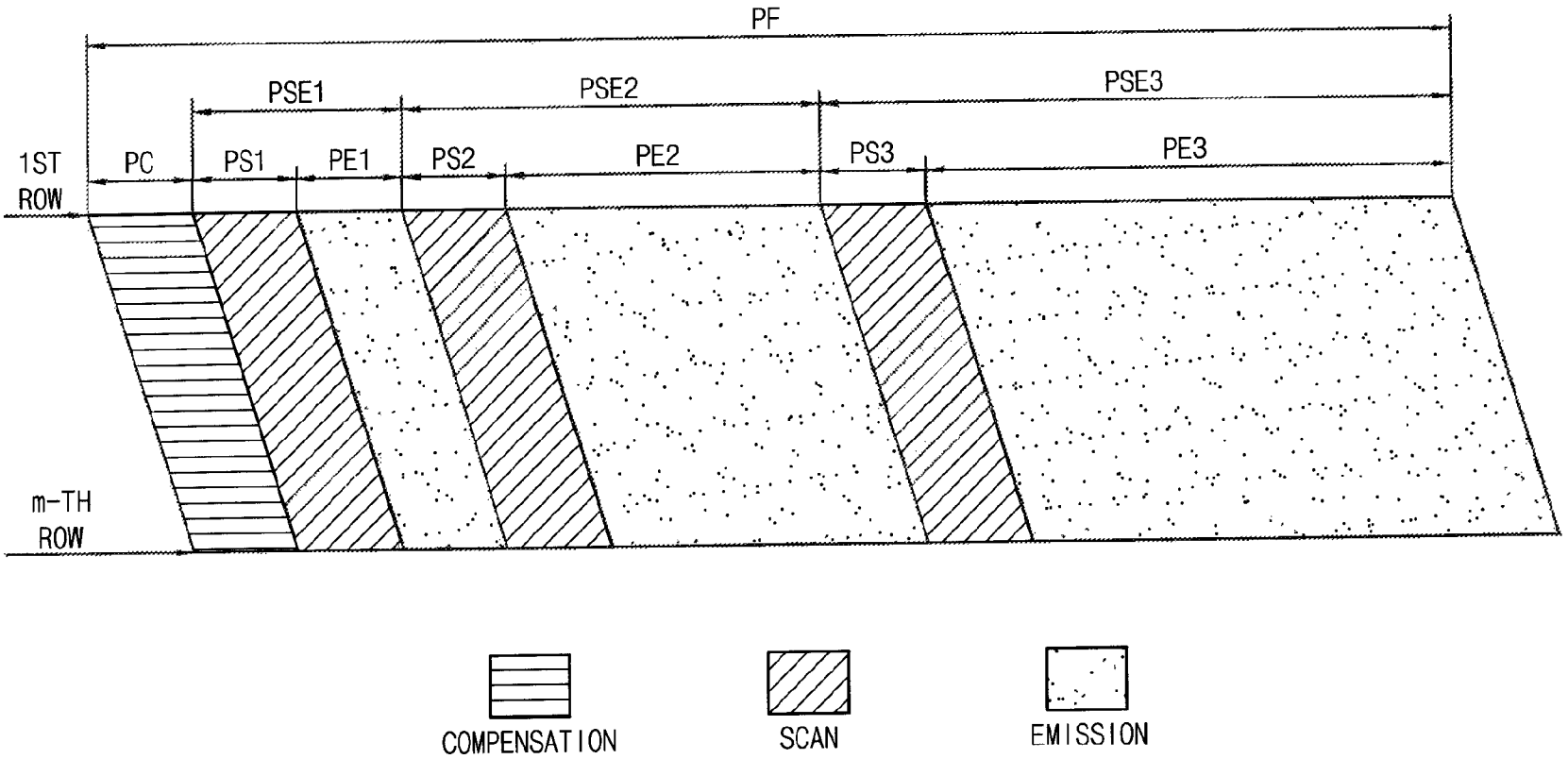
FIG. 5 is a diagram illustrating an example of driving the electroluminescent display of FIG. 3.

Referring to FIGS. 4 and 5, the scan driver 130 generates a plurality of compensation control signals CMP0~CMPm that are activated sequentially during time intervals T0~Tm. Also, the scan driver 130 generates a plurality of scan signals SCN1~SCNm that are activated sequentially during time intervals T2~Tm+1.

A (k−1)-th compensation control signal CMPk−1 and a k-th compensation control signal CMPk among the plurality of compensation control signals CMP0~CMPm are provide to the pixel circuits PX of a k-th row. Referring to the pixel circuit 10 of FIG. 1, the (k−1)-th compensation control signal CMPk−1 corresponds to the first compensation control signal CMPa and the k-th compensation control signal CMPk corresponds to the second compensation control signal CMPb. The k-th scan signal SCNk and the k-th emission control signal EMk correspond to the scan signal SCN and the emission control signal EM in FIG. 1, respectively.

Each pixel circuit PX of the k-th row can initialize the gate electrode of the driving transistor TD to the initial voltage VREF while the (k−1)-th compensation control signal CMPk−1 is activated. for example, during the first compensation period PC1. In addition, each pixel circuit PX of the k-th row can electrically connect the gate electrode N2 to the drain electrode N3 of the driving transistor TD while the k-th compensation control signal CMPk is activated, for example, during the second compensation period PC2. Each pixel circuit PX of the k-th row can turn on the scan transistor TS to apply each data voltage to the first node N1 while the k-th scan signal SCNk is activated, for example, during the scan period Ps that can be included in the scan-emission period PSE after the first and second compensation periods PC1 and PC2.

For example, the pixel circuits of the first row can operate in response to the zero-th compensation control signal CMP0, the first compensation control signal CMP1 and the first scan signal SCN1. For example, for the pixel circuits PX in the first row, the zero-th time interval T0 corresponds to the first compensation period PC1, the first time interval T1 corresponds to the second compensation period and the second time interval T2 corresponds to the scan period PS. The pixel circuits of the second row can operate in response to the first compensation control signal CMP1, the second compensation control signal CMP2 and the second scan signal SCN2. For example, for the pixel circuits PX in the second row, the first time interval T1 corresponds to the first compensation period PC1, the second time interval T2 corresponds to the second compensation period PC2 and the third time interval T3 corresponds to the scan period PS.

In this way, the voltage compensation operation can be performed sequentially row by row from the first row to the m-th row, and the scan operation can be performed sequentially row by row from the first row to the m-th row.

FIG. 5 illustrates the method of driving the electroluminescent display using the sequential voltage compensation operation and the sequential scan operation.

Referring to FIG. 5, each frame period PF includes a compensation period PS and a plurality of scan-emission periods PSE1~PSE3. The compensation period PS can begin sequentially from the first row to the m-th row, and also the scan-emission periods PSE1~PSE3 can begin sequentially from the first row to the m-th row after the compensation period PS. Each scan-emission period will be referred to as a sub-field driving period or a sub-frame driving period. The number of the scan-emission periods in each frame period PF can change variously.

FIG. 5 illustrates embodiments where the times of the emission periods PE1~PE3 increase gradually. In other embodiments, the times of the emission periods PE1~PE3 can decrease gradually. FIG. 5 illustrates embodiments of a progressive emission scheme where the emission period begins sequentially row by row. In other embodiments, the simultaneous emission scheme can be used such that the emission period begins at substantially the same time for all rows after the scan period is finished with respect to all rows.

Each of the scan-emission periods PSE1~PSE3 can include each of the scan periods PS1~PS3 and each of the emission periods PE1~PE3. As described above, each emission period PEi can begin after the corresponding scan period PSi is finished, or each scan period PSi can be included in the corresponding emission period PEi.

As described above, the compensation period PC includes the first compensation period PC1 for initializing the gate voltage of the driving transistor TD and the second compensation period PC2 for forming the diode-connection of the driving transistor TD.

As such, the method of driving the electroluminescent display including the pixel circuit according to example embodiments can compensate for the gate voltage of the driving transistor TD by reflecting the operational characteristics of the pixel circuit. This method reduces variations of brightness of the displayed image due to deviations of the power supply voltage and the threshold voltage of the driving transistor TD, temperature changes and degradation of the light-emitting diode LD, thereby enhancing quality of display image.

Figure 6:
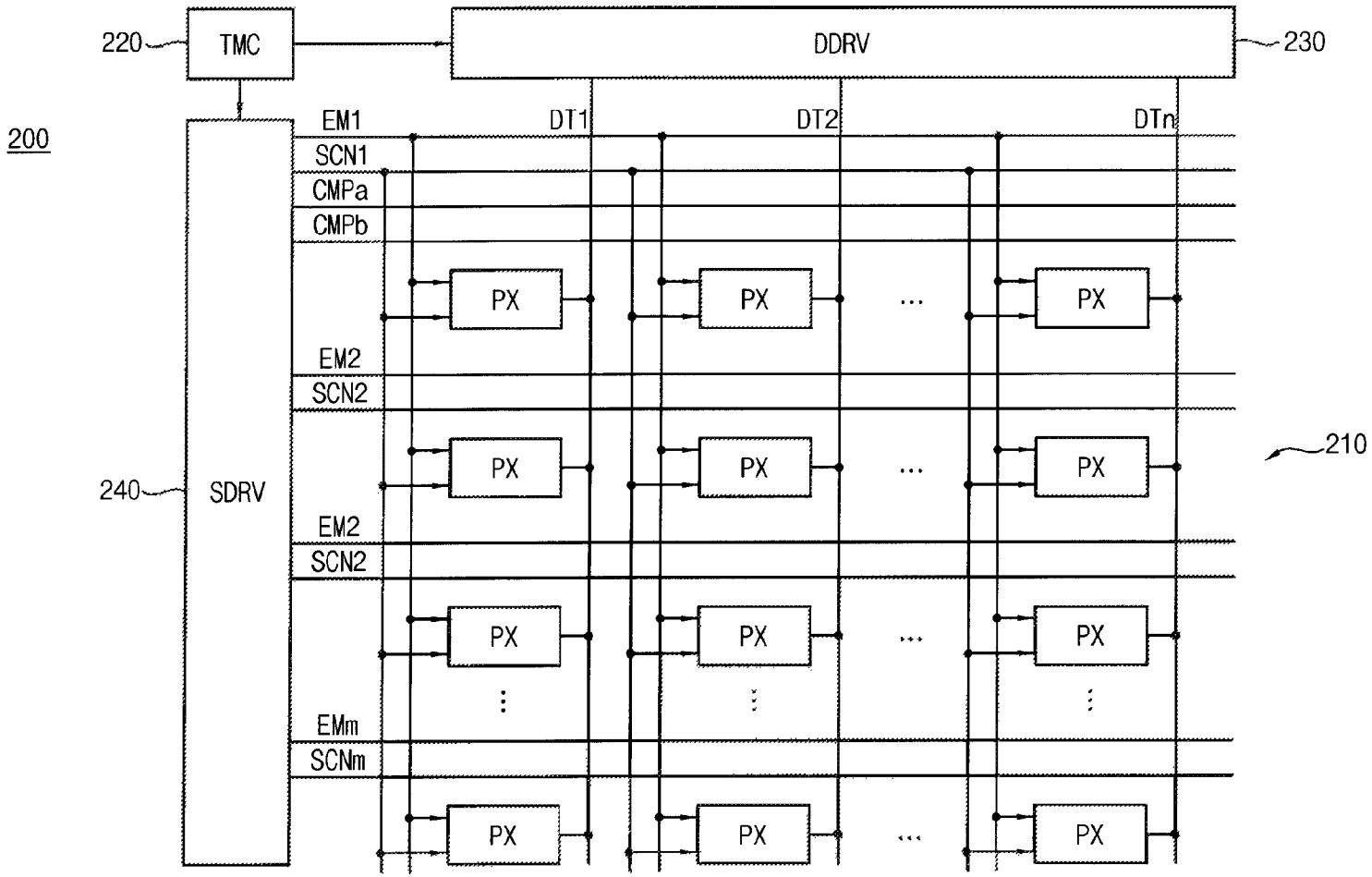
FIG. 6 is a block diagram illustrating an electroluminescent display according to an example embodiment.

FIG. 6 is a block diagram illustrating an electroluminescent display according to an example embodiment.

Referring to FIG. 6, an electroluminescent display 200 includes a display unit 210 and a driving unit. The driving unit includes a timing controller (TMC) 220, a data driver (DDRV) 230 and a scan driver (SDRV) 240. Even though not illustrated in FIG. 6, the electroluminescent display 200 can further include a buffer for storing image data to be displayed, a voltage generator, etc.

The display unit 210 includes a plurality of pixel circuits PX that are arranged in rows and columns. For example, the pixel circuits PX is arranged in a matrix form of m rows and n columns. The display unit 210 is coupled to the data driver 230 through a plurality of data lines, and is coupled to the scan driver 240 through a plurality of row control lines.

As described with reference to FIGS. 1 and 2, each pixel circuit PX can initialize the gate electrode of the driving transistor TD to the initial voltage VINT during the first compensation period PC1 and electrically connect the gate electrode to the drain electrode of the driving transistor TD during the second compensation period PC2 after the first compensation period PC1. Further, each pixel circuit PX can apply the reference voltage VREF to the first node N1 where the data bit is programmed during a scan period PS.

The data driver 230 provides data signals DT1~DTn to the display unit 210 through the data lines. The scan driver 240 provides row control signals to the display unit 110 through the row control lines. The row control signals include emission control signals EMP~EMm provided through emission control lines, scan signals SCN1~SCNm provided through scan lines, and first and second compensation control signals CMPa and CMPb provided through compensation control lines. The pixel circuits PX can be located where the data lines and the scan lines cross.

The driving unit 220, 230 and 240 can receive display data from an external and drive the display unit 210 to display an image corresponding to the display data. For example, the driving unit 220, 230 and 240 can drive the display unit 210 with a hybrid digital driving method in which the driving unit 220, 230 and 240 provide each pixel circuit PX with a data voltage (e.g., a voltage for turning on a driving transistor TD or a voltage for turning off the driving transistor TD) that allows the driving transistor TD to operate in the saturation region. The driving unit 220, 230 and 240 can produce a grayscale by adjusting the time duration for which the pixel circuit PX emits light in each frame. Unlike a typical digital driving method in which a driving transistor of each pixel circuit operates in the linear region, the display unit 210 can be driven with the hybrid digital driving method in which the driving transistor TD operates in the saturation region, thereby increasing the lifespan of the pixel circuits PX.

The timing controller 220 can control overall operations of the electroluminescent display 200. The timing controller 220 can provide control signals to control the display unit 210, the data driver 230 and the scan driver 240. In some embodiments, the timing controller 220, the data driver 230 and the scan driver 240 can be implemented as a single integrated circuit (IC). In other embodiments, the timing controller 220, the data driver 230 and the scan driver 240 can be implemented as two or more ICs.

As illustrated in FIG. 6, the emission control signal EMk and the corresponding scan signal SCNk are transmitted to the pixel circuits PX of the corresponding k-th row. The first and second compensation control signals CMPa and CMPb are provided commonly to the pixel circuits PX of all rows.

Hereinafter, the operation and the driving method of the electroluminescent display 200 are further described with reference to FIGS. 7 and 8.

Figure 7:
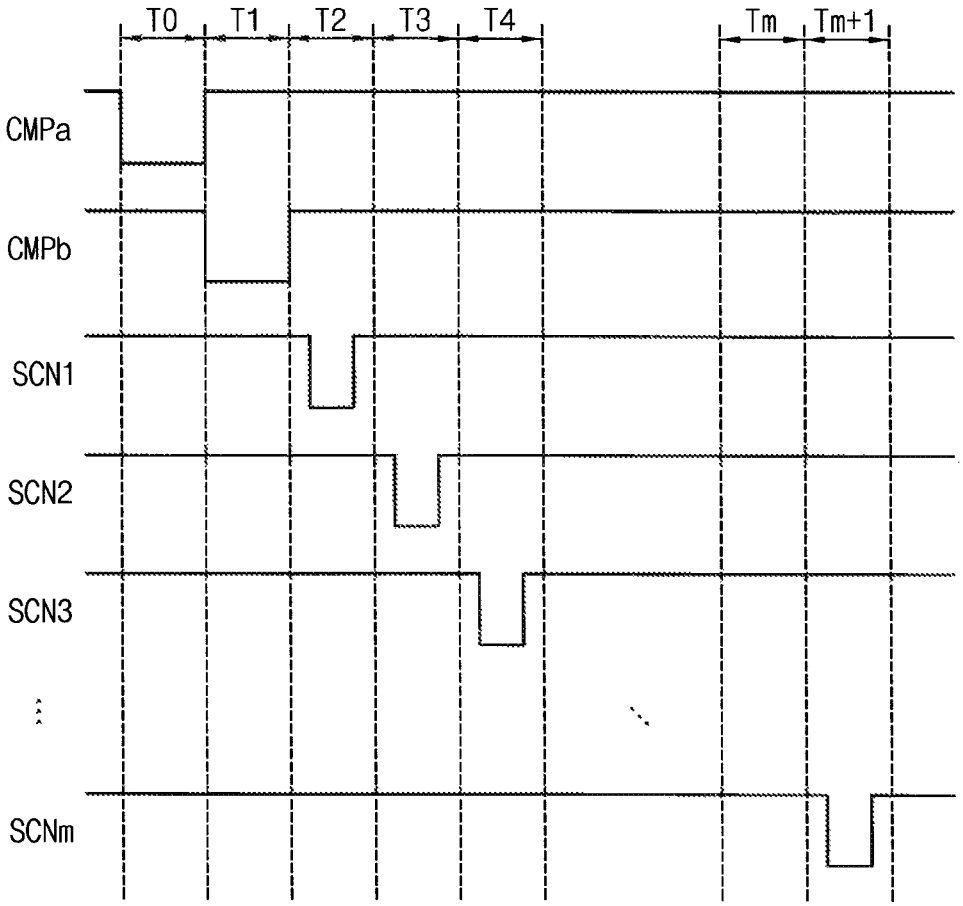
FIG. 7 is a timing diagram illustrating operations of the electroluminescent display of FIG. 6.

FIG. 7 is a timing diagram illustrating the operation of the electroluminescent display 200 of FIG. 6. FIG. 8 is a diagram illustrating an example of driving the electroluminescent display 200 of FIG. 6.

Figure 8:
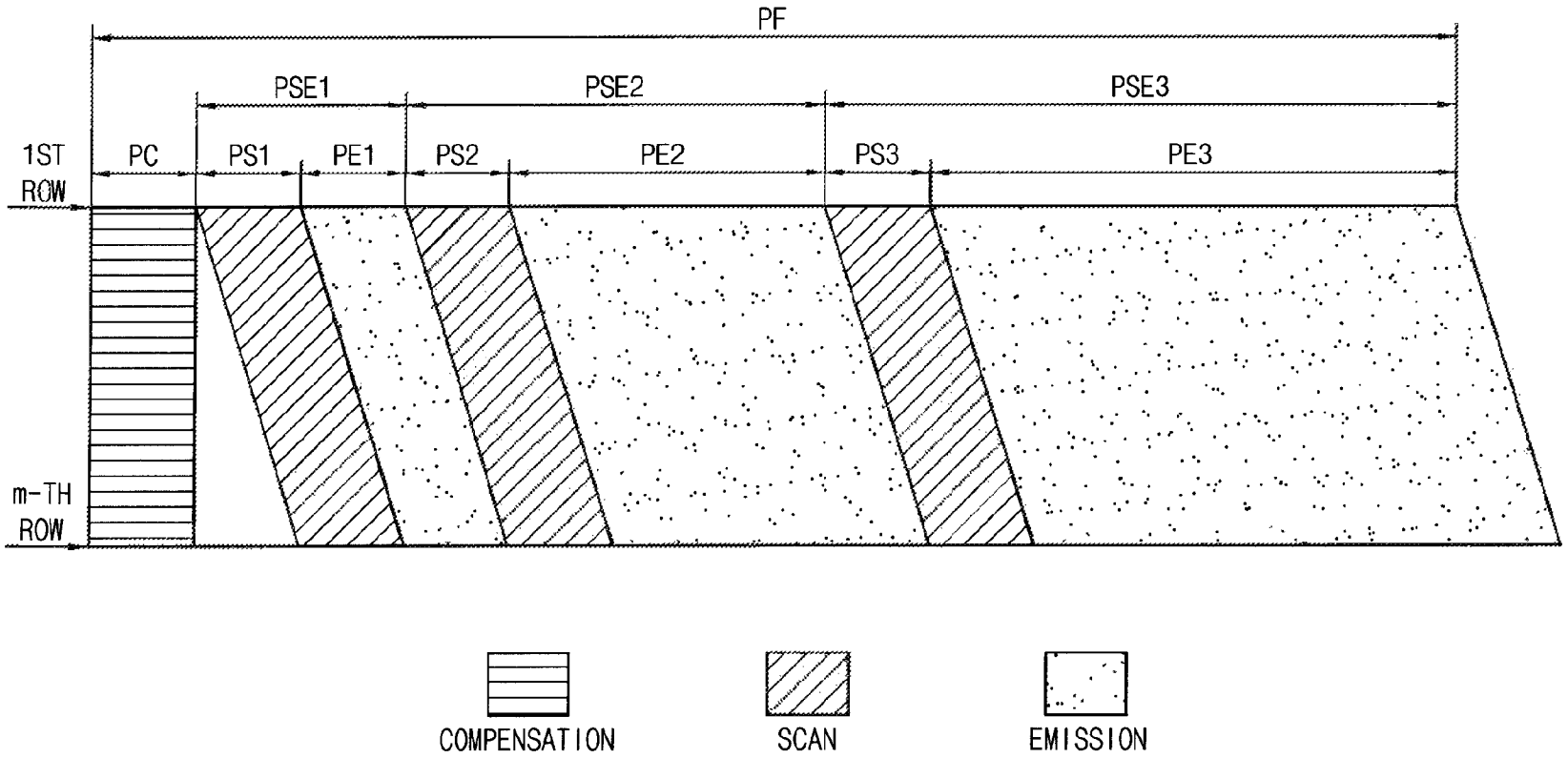
FIG. 8 is a diagram illustrating an example of driving the electroluminescent display of FIG. 6.

Referring to FIGS. 7 and 8, the scan driver 230 generates the first and second compensation control signals CMPa and CMPb that are activated sequentially during time intervals T0 and T1. Also the scan driver 230 generates a plurality of scan signals SCN1~SCNm that are activated sequentially during time intervals T2~Tm+1.

The first compensation control signal CMPa and the second compensation control signal CMPb are provided commonly to the pixel circuits PX of all rows. Referring again to the pixel circuit 10 of FIG. 1, the first and second compensation signals CMPa and CMPb are common with respect to all rows. The k-th scan signal SCNk and the k-th emission control signal EMk correspond to the scan signal SCN and the emission control signal EM in FIG. 1, respectively.

Each pixel circuit PX of all rows can initialize the gate electrode of the driving transistor TD to the initial voltage while the first compensation control signal CMPa is activated during the first compensation period PC1. In addition, each pixel circuit PX of all rows can electrically connect the gate electrode N2 to the drain electrode N3 of the driving transistor TD while the second compensation control signal CMPb is activated during the second compensation period PC2. Each pixel circuit PX of the k-th row can turn on the scan transistor TS so as to apply each data voltage to the first node N1 while the k-th scan signal SCNk is activated during the scan period Ps that can be included in the scan-emission period PSE after the first and second compensation periods PC1 and PC2.

For example, the pixel circuits of the first row can operate in response to the first compensation control signal CMPa, the second compensation control signal CMPb and the first scan signal SCN1. For example, when the pixel circuits PX of the first row, the zero-th time interval T0 corresponds to the first compensation period PC1, the first and second time intervals T1 and T2 respectively corresponds to the second compensation period and the scan period PS. The pixel circuits of the second row can operate in response to the first compensation control signal CMPa, the second compensation control signal CMPb and the second scan signal SCN2. For example, for the pixel circuits PX of the second row, the zero-th time interval T0 corresponds to the first compensation period PC1, the first time interval T1 corresponds to the second compensation period PC2, and the third time interval T3 corresponds to the scan period PS.

In this way, the voltage compensation operation can be performed substantially simultaneously with respect to all rows from the first row to the m-th row, and the scan operation can be performed sequentially row by row from the first row to the m-th row.

FIG. 8 illustrates the method of driving the electroluminescent display using the substantially simultaneous voltage compensation operation and the sequential scan operation.

Referring to FIG. 8, each frame period PF includes a compensation period PS and a plurality of scan-emission periods PSE1~PSE3. The compensation period PS can begin substantially simultaneously with respect to all rows from the first row to the m-th row, and the scan-emission periods PSE1~PSE3 can begin sequentially from the first row to the m-th row after the compensation period PS. Each scan-emission period will be referred to as a sub-field driving period or a sub-frame driving period. The number of the scan-emission periods in each frame period PF can be changed variously.

FIG. 8 illustrates embodiments where the times of the emission periods PE1~PE3 increase gradually. In other embodiments, the times of the emission periods PE1~PE3 decrease gradually. FIG. 8 illustrates embodiments of a progressive emission scheme where the emission period begins sequentially row by row, and the simultaneous emission scheme can be adopted in other embodiments such that the emission period begins at substantially the same time for all rows after the scan period is finished with all rows.

Each of the scan-emission periods PSE1~PSE3 can include each of the scan periods PS1~PS3 and each of the emission periods PE1~PE3. As described above, each emission period PEi can begin after the corresponding scan period PSi is finished, or each scan period PSi can be included in the corresponding emission period PEi.

As described above, the compensation period PC includes the first compensation period PC1 for initializing the gate voltage of the driving transistor TD and the second compensation period PC2 for forming the diode-connection of the driving transistor TD.

As such, the method of driving the electroluminescent display including the pixel circuit according to embodiments can compensate for the gate voltage of the driving transistor TD by reflecting the operational characteristics of the pixel circuit so as to reduce variations of brightness of the displayed image due to deviations of the power supply voltage and the threshold voltage of the driving transistor TD, temperature changes and degradation of the light-emitting diode LD, thereby enhancing quality of display image.

Figure 9:
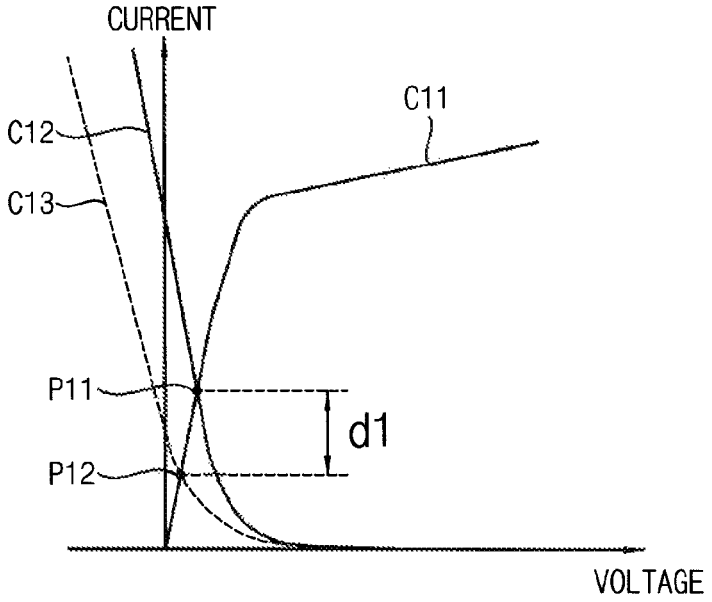
FIGS. 9 and 10 are diagrams for describing operational characteristics of a pixel circuit according to example embodiments.
Figure 10:
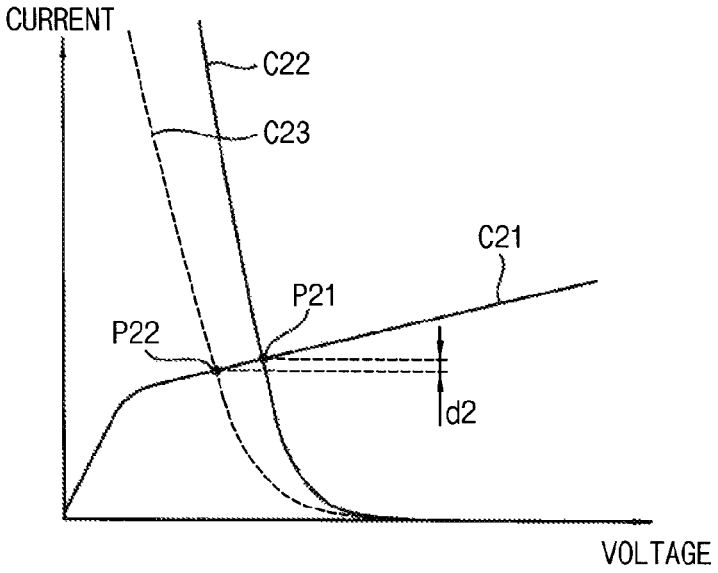

FIGS. 9 and 10 are diagrams for describing operational characteristics of a pixel circuit according to some embodiments.

FIG. 9 illustrates an example where the driving transistor TD operates in the linear region. FIG. 10 illustrates an example where the driving transistor TD operates in the saturation region. The curves C11 and C21 are current-voltage (I-V) curves representing the relationship between the current and the source-drain voltage of the driving transistor TD. The curves C12 and C22 are I-V curves of the normal light-emitting diode LD, and the curves C13 and C23 are I-V curves of the degenerated light-emitting diode LD.

Referring to FIG. 9, the driving transistor TD operates in the linear region in the typical pixel circuit where the driving transistor is used as a switch. The current at the point P11, which is a crossing point of the curves C11 and C12, flows through the light-emitting diode LD to emit light. The driving current changes very sensitively to change of the I-V characteristic of the light-emitting diode LD because the driving transistor TD operates in the linear region. When the light-emitting diode LD is degraded or the operation time is changed, the driving current is changed to the point P12. As illustrated in FIG. 9, the amount d1 of the driving current change is relatively large, and thus the brightness deviation of the light-emitting diode LD is increased.

Referring to FIG. 10, the pixel circuit according to embodiments operates in the saturation region and thus the amount d2 of the driving current change is relatively small. As such, the pixel circuit operating in the saturation region and the electroluminescent display including the pixel circuit can reduce the brightness deviation due to temperature changes and degradation of the light-emitting diode, thereby enhancing quality of display images.

Figure 11:
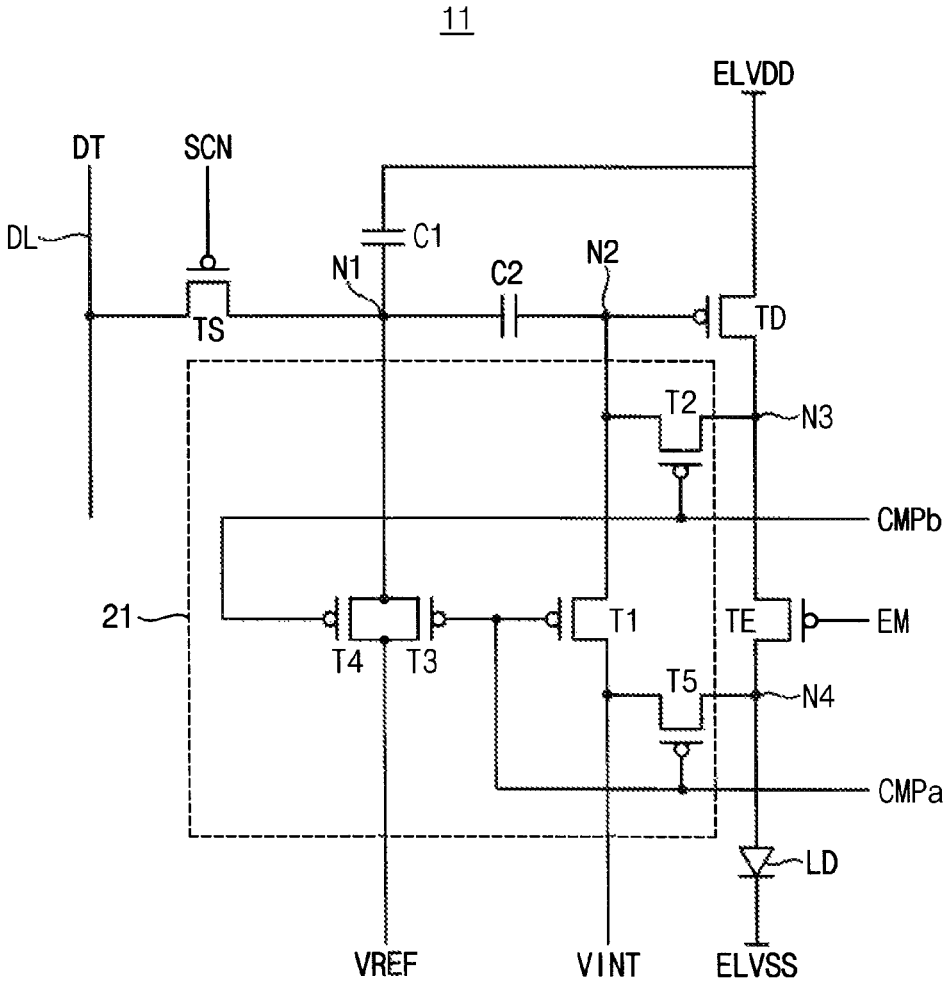
FIGS. 11 and 12 are circuit diagrams illustrating a pixel circuit according to example embodiments.
Figure 12:
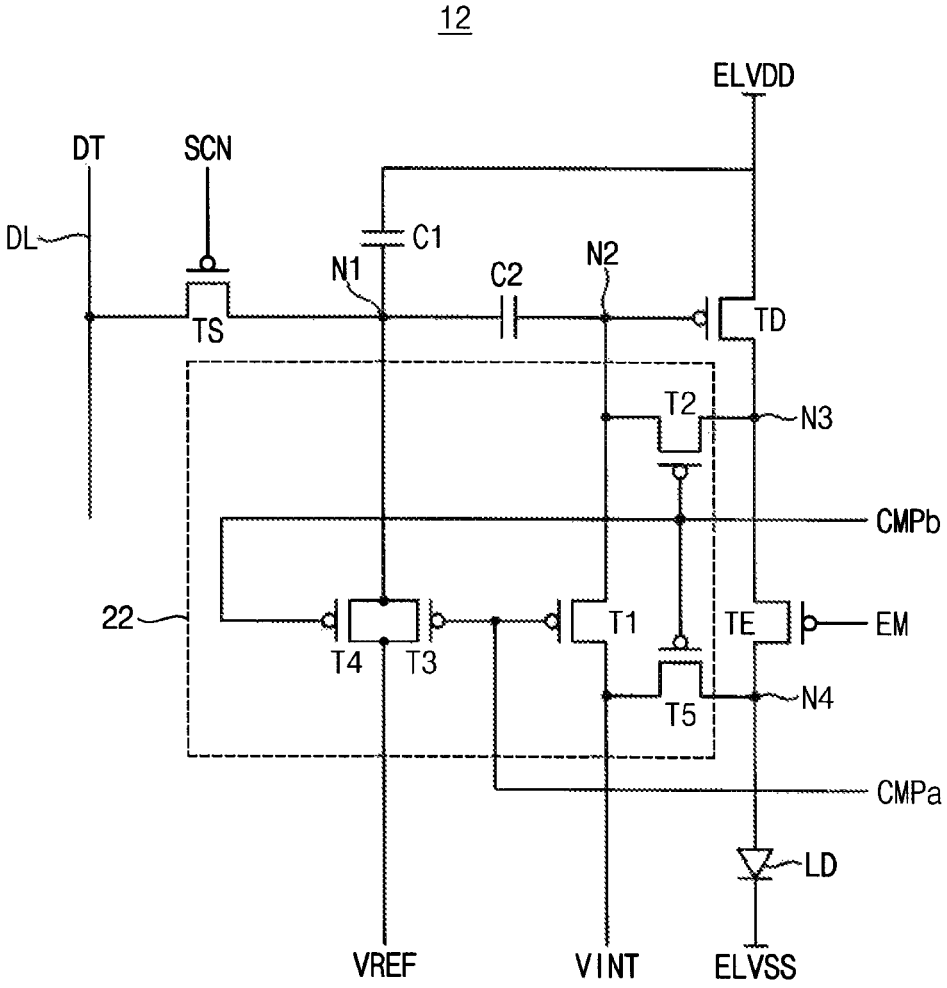

FIGS. 11 and 12 are circuit diagrams illustrating a pixel circuit according to embodiments.

Referring to FIGS. 11 and 12, each of pixel circuits 11 and 12 includes a scan transistor TS, a first capacitor C1, a second capacitor C2, a driving transistor TD, an emission control transistor TE, a light-emitting diode LD and each of compensation circuits 21 and 22.

The scan transistor TS is coupled between a data line DL and a first node N1. A gate electrode of the scan transistor TS receives a scan signal SCN. The first capacitor C1 is coupled between a first power supply voltage ELVDD and the first node N1. The second capacitor C2 is coupled between the first node N1 and a second node N2. The driving transistor TD is coupled between the first power supply voltage ELVDD and a third node N3. A gate electrode of the driving transistor TD is coupled to the second node N2. The emission control transistor TE is coupled between the third node N3 and a fourth node N4, and a gate electrode of the emission control transistor TE receives an emission control signal EM. The light-emitting diode LD is coupled between the fourth node N4 and a second power supply voltage ELVSS that is less than the first power supply voltage ELVDD.

As described with reference to FIG. 1, each of the compensation circuits 21 and 22 includes a first transistor T1, a second transistor T2, a third transistor T3 and a fourth transistor T4, bus the compensation circuits 21 and 22 are not limited thereto.

The first transistor T1 is coupled between the second node N2 and the initial voltage VINT. A gate electrode of the first transistor T1 receives a first compensation control signal CMPa that is activated during the first compensation period PC1. The second transistor T2 is coupled between the second node N2 and the third node N3, and a gate electrode of the second transistor T2 receives a second compensation control signal CMPb that is activated during the second compensation period PC2. Using the first and second transistors T1 and T2, the second node N2 can be initialized to an initial voltage VINT during the first compensation period PC1. Also, using the first and second transistors T1 and T2, the second node N2 and the third node N3 can be electrically connected to each other during the second compensation period PC2 after the first compensation period PC1.

The third transistor T3 is coupled between the first node N1 and a reference voltage VREF. A gate electrode of the third transistor T3 receives the first compensation control signal CMPa. The fourth transistor T4 is coupled between the first node N1 and the reference voltage VREF. A gate electrode of the fourth transistor T4 receives the second compensation control signal CMPb. Using the third and fourth transistors T3 and T4, the reference voltage VREF can be applied to the first node N1 during the first compensation period PC1 and the second compensation period PC2.

As illustrated in FIGS. 11 and 12, the compensation circuit 21 further includes a fifth transistor T5 coupled between the fourth node N4 and the initial voltage VINT. In the embodiment of FIG. 11, a gate electrode of the fifth transistor T5 receives the first compensation control signal CMPa. In the embodiment of FIG. 12, a gate electrode of the fifth transistor T5 receives the second compensation control signal CMPb. Using the transistor T5, the initial voltage VINT can be applied to the fourth node N4 during the first compensation period PC1 or during the second compensation period PC2. When the driving voltage TD is turned off, such initialization of the fourth node N4 to the relatively low initial voltage VINT can reduce noises due to remaining charges at the third node N3.

Figure 13:
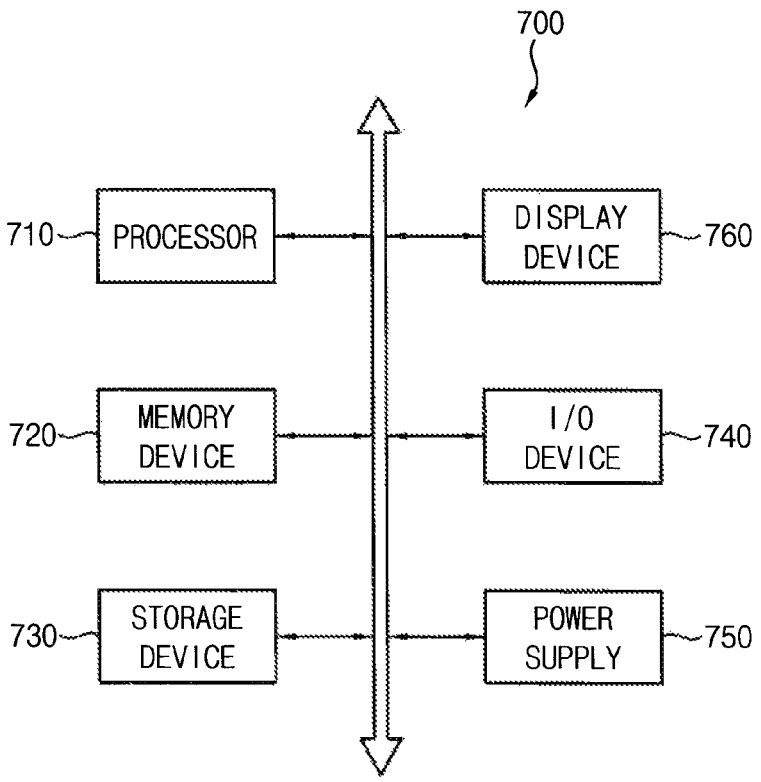
FIG. 13 is a block diagram illustrating a mobile device according to example embodiments.

FIG. 13 is a block diagram illustrating a mobile device according to example embodiments.

Referring to FIG. 13, a mobile device 700 includes a processor 710, a memory device 720, a storage device 730, an input/output (I/O) device 740, a power supply 750, and an electroluminescent display 760. The mobile device 700 can further include a plurality of ports for communicating a video card, a sound card, a memory card, a universal serial bus (USB) device, or other electronic systems.

The processor 710 can perform various computing functions or tasks. The processor 710 can be for example, a microprocessor, a central processing unit (CPU), etc. The processor 710 can be connected to other components via an address bus, a control bus, a data bus, etc. Further, the processor 710 can be coupled to an extended bus such as a peripheral component interconnection (PCI) bus.

The memory device 720 can store data for operations of the mobile device 700. For example, the memory device 720 can include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 can be, for example, a solid state drive (SSD) device, a hard disk drive (HDD) device, a CD-ROM device, etc. The I/O device 740 can be, for example, an input device such as a keyboard, a keypad, a mouse, a touch screen, and/or an output device such as a printer, a speaker, etc. The power supply 750 can supply power for operating the mobile device 700. The electroluminescent display 760 can communicate with other components via the buses or other communication links.

As described above with reference to FIGS. 1 through 12, the electroluminescent display 760 includes a plurality of pixel circuits such that each pixel circuit is configured to initialize a gate electrode of a driving transistor to an initial voltage during a first compensation period and electrically connect the gate electrode to a drain electrode of the driving transistor during a second compensation period after the first compensation period.

The present embodiments can be applied to any mobile device or any computing device. For example, the present embodiments can be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A pixel circuit for an electroluminescent display, comprising:

a scan transistor connected between a data line and a first node and having a gate electrode configured to receive a scan signal;

a first capacitor connected between a first power supply voltage and the first node;

a second capacitor connected between the first node and a second node;

a driving transistor connected between the first power supply voltage and a third node and having a gate electrode connected to the second node;

an emission control transistor connected between the third node and a fourth node and having a gate electrode configured to receive an emission control signal;

a light-emitting diode (LED) connected between the fourth node and a second power supply voltage less than the first power supply voltage; and a compensation circuit configured to i) initialize the second node to an initial voltage during a first compensation period and ii) electrically connect the second node to the third node during a second compensation period following the first compensation period, wherein the compensation circuit includes a first transistor directly connected to both the second node and an initial voltage node having the initial voltage, wherein the first transistor comprises a gate electrode configured to receive a first compensation control signal configured to be activated during the first compensation period, wherein the initial voltage node is directly connected to only the first transistor, and wherein the compensation circuit is further configured to apply a reference voltage to the first node during the first and second compensation periods.

2. The pixel circuit of claim 1, wherein, when the scan transistor is turned on by the scan control signal, the driving transistor is configured to be turned on when a data voltage on the data line is less than the reference voltage and the driving transistor is configured to be turned off when the data voltage is greater than the reference voltage.

3. A pixel circuit for an electroluminescent display, comprising:

a scan transistor connected between a data line and a first node and having a gate electrode configured to receive a scan signal;

a first capacitor connected between a first power supply voltage and the first node;

a second capacitor connected between the first node and a second node;

a driving transistor connected between the first power supply voltage and a third node and having a gate electrode connected to the second node;

an emission control transistor connected between the third node and a fourth node and having a gate electrode configured to receive an emission control signal;

a light-emitting diode (LED) connected between the fourth node and a second power supply voltage less than the first power supply voltage; and a compensation circuit configured to i) initialize the second node to an initial voltage during a first compensation period and ii) electrically connect the second node to the third node during a second compensation period following the first compensation period, wherein the compensation circuit includes a first transistor directly connected to both the second node and an initial voltage node having the initial voltage, wherein the first transistor comprises a gate electrode configured to receive a first compensation control signal configured to be activated during the first compensation period, wherein the initial voltage node is directly connected to only the first transistor, and wherein the compensation circuit is further configured to apply the initial voltage to the fourth node during the first or second compensation period.

4. The pixel circuit of claim 1, wherein the first and second compensation periods and a scan period after the second compensation period are defined as a frame period of the electroluminescent display, and wherein the scan transistor is configured to be turned on during the scan period.

5. The pixel circuit of claim 1, wherein the initial voltage is less than the difference between the first power supply voltage and a threshold voltage of the driving transistor.

6. The pixel circuit of claim 1, wherein the initial voltage is substantially equal to the second power supply voltage.

7. The pixel circuit of claim 1, wherein the compensation circuit includes:

a second transistor connected between the second node and the third node and having a gate electrode configured to receive a second compensation control signal that is activated during the second compensation period.

8. The pixel circuit of claim 7, wherein the compensation circuit further includes:

a third transistor connected between the first node and a reference voltage node having a reference voltage, wherein the third transistor comprises a gate electrode configured to receive the first compensation control signal; and a fourth transistor connected between the first node and the reference voltage node and having a gate electrode configured to receive the second compensation control signal.

9. The pixel circuit of claim 8, wherein the compensation circuit further includes:

a fifth transistor connected between the fourth node and the initial voltage node and having a gate electrode configured to receive the first compensation control signal or the second compensation control signal.

10. The pixel circuit of claim 1, wherein the driving transistor is configured to operate in a saturation region.

11. An electroluminescent display comprising:

a display unit including a plurality of pixel circuits arranged in rows and columns, wherein each pixel circuit i) includes a driving transistor including a gate electrode configured to be initialized to an initial voltage during a first compensation period and ii) is configured to turn on the driving transistor during a second compensation period following the first compensation period, wherein each pixel circuit includes a first transistor directly connected to both the gate electrode of the driving transistor and an initial voltage node having the initial voltage, wherein a gate electrode of the first transistor is configured to receive a first compensation control signal configured to be activated during the first compensation period, and wherein the initial voltage node is directly connected to only the first transistor;

a data driver configured to provide data signals to the display unit;

a scan driver configured to provide row control signals to the display unit, wherein the scan driver is configured to generate and sequentially activate a plurality of compensation control signals, and wherein the pixel circuits of a k-th row are configured to receive (k−1)-th and k-th compensation control signals; and a timing controller configured to control the display unit, the data driver and the scan driver.

12. The electroluminescent display of claim 11, wherein each pixel circuit of the k-th row is configured to i) initialize the gate electrode of the driving transistor to the initial voltage while the (k−1)-th compensation control signal is activated and ii) turn on the driving transistor while the k-th compensation control signal is activated.

13. The electroluminescent display of claim 11, wherein the scan driver is configured to generate and sequentially activate first and second compensation control signals.

14. The electroluminescent display of claim 13, wherein each of the pixel circuits is further configured to receive the first and second compensation control signals.

15. The electroluminescent display of claim 14, wherein each pixel circuit is configured to i) initialize the gate electrode of the driving transistor to the initial voltage while the first compensation control signal is activated and ii) turn on the driving transistor while the second compensation control signal is activated.

16. The electroluminescent display of claim 11, wherein each pixel circuit includes:

a scan transistor connected between a data line and a first node and having a gate electrode configured to receive a scan signal;

a first capacitor connected between a first power supply voltage and the first node;

a second capacitor connected between the first node and a second node;

an emission control transistor connected between a third node and a fourth node and having a gate electrode configured to receive an emission control signal;

a light-emitting diode (LED) connected between the fourth node and a second power supply voltage less than the first power supply voltage; and a compensation circuit configured to i) initialize the second node to an initial voltage during the first compensation period and ii) electrically connect the second node to the third node during the second compensation period, wherein the driving transistor is connected between the first power supply voltage and the third node, and wherein the gate electrode of the driving transistor is connected to the second node.

17. The electroluminescent display of claim 16, wherein the compensation circuit includes:

a second transistor connected between the second node and the third node and having a gate electrode configured to receive a second compensation control signal that is activated during the second compensation period;

a third transistor having a gate electrode and connected between the first node and a reference voltage node having a reference voltage, wherein the gate electrode of the third transistor is configured to receive the first compensation control signal; and a fourth transistor connected between the first node and the reference voltage node and having a gate electrode configured to receive the second compensation control signal.

* * * * *